United States Patent [19]

Laesser

[11] 4,087,959

[45] May 9, 1978

[54] DRIVING MECHANISM OF A MEMBER OF TIMEPIECE MOVING INTERMITTENTLY

[75] Inventor: Claude Laesser, La Chaux-de-Fonds, Switzerland

[73] Assignee: Ebauches S.A., Switzerland

[21] Appl. No.: 720,666

[22] Filed: Sep. 7, 1976

[30] Foreign Application Priority Data

Sep. 9, 1975 Switzerland ..... 11690/75

[51] Int. Cl.[2] ..... G04B 15/00

[52] U.S. Cl. ..... 58/116 M; 58/58; 58/1 M

[58] Field of Search ..... 58/4 R, 4 A, 7, 57, 58/58, 85.5, 1 M, 116 M; 235/144 ME

[56] References Cited

U.S. PATENT DOCUMENTS

| | | | |
|---|---|---|---|
| 2,964,901 | 12/1960 | Betner et al. | 58/121 R |
| 3,036,424 | 5/1962 | Perrot | 58/58 |
| 3,815,351 | 6/1974 | Vouelle | 58/4 A |
| 3,969,888 | 7/1976 | Jeuilleumiel et al. | 58/58 |
| 3,993,895 | 11/1976 | Baermann | 235/144 ME |

FOREIGN PATENT DOCUMENTS

| | | | |
|---|---|---|---|
| 2,124,661 | 6/1973 | Germany | 58/58 |

*Primary Examiner*—Robert K. Schaefer
*Assistant Examiner*—Vit W. Miska
*Attorney, Agent, or Firm*—St.Onge, Mayers, Steward & Reens

[57] ABSTRACT

A crown ring for a date indicator is moved once during each revolution of a continuously rotating plate or driving member, which plate has a cam-shaped member of magnetic material that rotates with it and cooperates with a magnet in order to substantially eliminate the variations in torque required to rotate the plate. To this end, the profile of the cam-shaped member is such that during the portion of each revolution of the plate when the crown is moved, the surface of the cam comes rapidly closer to the magnet increasing the pull of the magnet on it, and during the remainder of each revolution, it recedes. The magnet, therefore, helps to rotate the plate when the crown is being moved in order to offset the torque required to move the crown, while placing only a slight drag on the plate during the balance of each revolution of the plate.

1 Claim, 2 Drawing Figures

DRIVING MECHANISM OF A MEMBER OF TIMEPIECE MOVING INTERMITTENTLY

BACKGROUND OF THE INVENTION

The present invention relates to a driving mechanism for a member of timepiece moving intermittently, especially of a date or days indicator which moves one step each 24 hours, and comprises a driving member which rotates continuously and which is provided with means acting once each revolution, at least indirectly on a driven member, i.e. the intermittently moving member.

Mechanisms of this type, especially date mechanisms of the so-called dragging type (namely those in which the intermittently driven member rotates at least for a portion of each of its steps at the speed of the driving member) have the advantage of having good efficiency in that the energy which is transmitted by the gearing of the movement to the mechanism driving the intermittently moving member is very close to that required for driving this member. Consequently, there is less loss of energy as compared to mechanisms of the so-called instantaneous type in which the member moving intermittently effects its movements in sudden steps, thereby giving rise to a loss of energy due to the shock each time the intermittent member moves.

However, in the case of the mechanisms of the dragging type, if the efficiency is good, the distribution of the consumption of energy is bad since the driving member travels through a large portion of its stroke without furnishing any driving energy to the member moving intermittently and must furnish energy for this purpose only during a short portion of its stroke during which it is necessary to apply a relatively high torque to this member. Consequently, the movement has to be arranged in such a way as to be able to furnish such high peaks of torque.

In mechanisms of the instantaneous type, this inconvenience does not exist because the energy is generally accumulated by a spring during the entire revolution of the driving member, this stored energy being suddenly released when the intermittently moving member is driven.

The purpose of the present invention is to better distribute the consumption of energy in the case of the mechanisms of the dragging type, thereby permitting reduction in the maximum torque which has to be furnished to the driving mechanism of the intermittently moving member.

SUMMARY OF THE INVENTION

To this end, the driving mechanism according to the invention is characterized by the fact that the driving member is rigid with a cam-shaped member made of a soft magnetic material with which cooperates a stationary magnet, the profile of the said cam being such that during the portion of each revolution of the driving member when the driven member is being moved, the distance between the surface of the cam and the magnet decreases as the driving member rotates, while during the remainder of each revolution of the driving member, the distance between the surface of the cam and the magnet increases, whereby the reluctance of the magnetic circuit constituted by the cam and the magnet varies in such a way that the torque applied to the driving member by the gearing of the movement of the timepiece is substantially constant throughout, whether or not the driven member is actually being moved.

DETAILED DESCRIPTION OF THE PREFERRED EMBODIMENT

Figure 1:
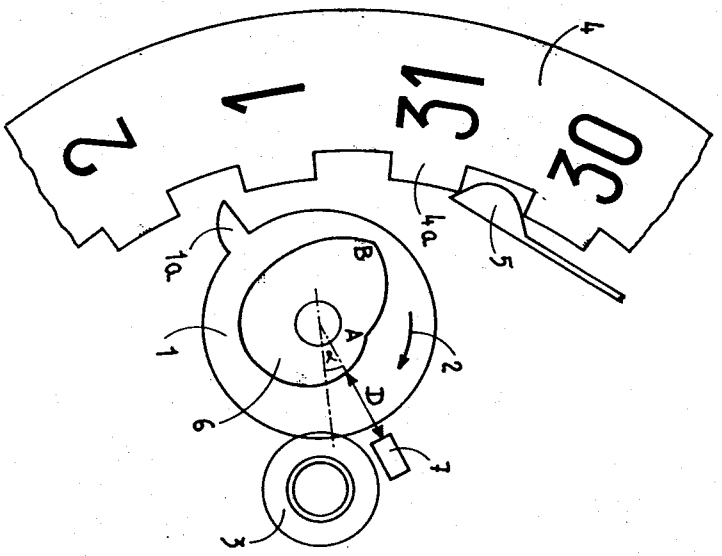

The drawing shows, by way of example, one embodiment of the invention.

Figure 2:
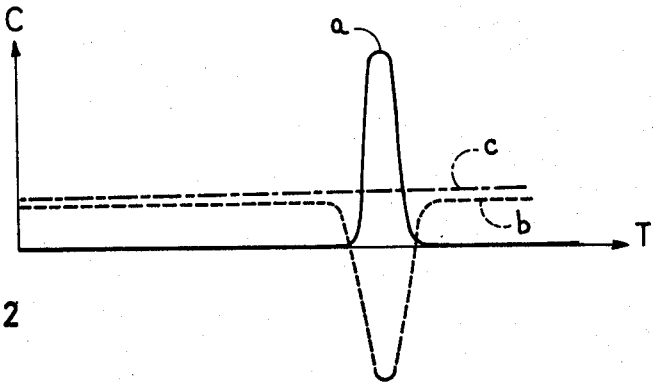

FIG. 1 is a diagrammatic plan view of a driving member of the dragging type for a date indicator, and FIG. 2 is a diagram of the torque as a function of time.

The driving mechanism represented in FIG. 1 comprises a plate 1 rigid with a wheel, not represented, making one revolution per twenty-four hours, driven in the direction of the arrow 2 by the hour wheel of the movement, designated by 3. This plate 1 is provided with a finger 1*a* which cooperates on each revolution, with the inner toothing, designated by 4*a*, of a crown 4 carrying the indication of the dates. The step-by-step movements of the crown 4 are controlled at each half step by the finger 1*a*, and are ended by a jumper diagrammatically represented at 5.

The plate 1 making one revolution per twenty-four hours is rigid with a cam 6, made of a soft magnetic material, situated at the level of a magnetic bar 7 carried by the frame of the movement. This bar could be mounted on the frame in such a way that its position be adjustable. The profile and the angular position of the cam 6 on the plate 1 are such that, when the finger 1*a* of the plate is meshing with one of the teeth 4*a* of the inner toothing of the crown 4, the distance between the said cam and the magnet 7 is decreasing as the plate 1 is rotating, and when the finger 1*a* is not meshing with the toothing of the crown 4, the distance between the cam and the magnet is increasing as the plate rotates. In the first case, the portion of cam 6 extending from A to B (counterclockwise about the axis of rotation) is situated opposite the magnet, this portion representing only a short part of the whole periphery of the cam, while in the second case, the balance of the surface of the cam from B to A is situated opposite the magnet.

Owing to this arrangement, the reluctance of the magnetic circuit constituted by the cam 6 and the magnet varies continuously during the rotation of the cam, permitting energy to be stored and released. Cam 6 is thus attracted by the magnet 7, which applies thereon a force when the finger 1*a* cooperates with the date crown 4 for driving it, while on the contrary, cam 6 must tear itself from the magnet when the plate 1 effects its portion of rotation during which it does not drive the crown 4.

The profile of the cam is determined in such a way that the energy which is necessary to rotate the plate 1 that is furnished by the gearing of the movement is substantially constant, whether or not the plate is acting on the date crown 4.

Calculation shows that, for good distribution of the torque, it is necessary that the derivative of the square of the distance D separating the magnet 7 from the cam 6, with respect to the angle $\alpha$ at the center of the cam 6, measured with respect to any point of origin, should be constant. In other words, one must have the following relation:

$$dD^2/d\alpha = \text{constant}$$

In the diagram of FIG. 2, the torque C is indicated along the ordinates of the time T along the abscissa. The three curves *a*, *b*, and *c* are, respectively, the torque necessary for driving the date crown, the torque applied to the cam 6 by the magnet 7, and the torque necessary for driving the plate 1 which is furnished by the gearing of the movement.

As can be seen, the torque necessary for driving the date crown (curve *a*) is zero most of the time and shows a relatively high peak which extends only for a very short time. Constructively, the torque necessary for driving the cam 6 (curve *b*) is low most of the time and shows a peak, extending for a short time, in opposite phase to the peak of the torque of curve *a*. Hence, the torque which has to be applied to the plate 1, represented by the curve *c*, is substantially constant, being slightly higher than the torque necessary for driving the cam 6, represented by the curve *b*, in the period of time when the plate 1 does not drive the date crown, the difference being due to the torque necessary for driving the plate itself, independently of the presence of the cam 6.

It is to be noted that, in the case of an electric watch, one could, owing to the present arrangement, eliminate the friction device acting on the seconds axis for preventing the "flapping" of the second hand. As a matter of fact, the torque of the driving mechanism for the date indicator is exerted permanently on the gearing of the movement and prevents any flapping of this gearing and, consequently of the second hand.

What I claim is:

1. In a driving mechanism for a timepiece having gearing for continuously rotating a driving member in one direction, a driven member and means for moving said driven member intermittently in step-by-step fashion on rotation of said driving member, one step for each revolution of said driving member, whereby said driven member is moved only during a predetermined portion of each revolution of said driving member, the improvement comprising a cam-shaped member rigid with said driving member for rotation therewith, said cam-shaped member being made of a soft magnetic material and a stationary magnet mounted in spaced relation with respect to said cam-shaped member for cooperation therewith, the profile of said cam-shaped member being such that during said predetermined portion of each revolution of said driving member, the distance between the surface of said camshaped member and magnet decreases as said driving member rotates, while during the remainder of each revolution of said driving member, the distance between the surface of said cam-shaped member and said magnet increases, whereby the reluctance of the magnetic circuit constituted by said cam-shaped member and magnet varies in such a way that the torque applied to the driving member by the gearing of said timepiece is substantially constant throughout each revolution of said driving member.

* * * * *